US006123540A

United States Patent [19]

Ogata et al.

[11] Patent Number: 6,123,540

[45] **Date of Patent: *Sep. 26, 2000**

[54] HEAVY OIL EMULSION FUEL COMBUSTION APPARATUS

[75] Inventors: Kan Ogata; Akira Yamada; Kimishiro Tokuda; Toshimitsu Ichinose; Hiroshi Kikuchi; Yasuo Souda, all of Nagasaki; Satoshi Uchida; Syozo Kaneko, both of Tokyo, all of Japan

[73] Assignee: Mitsubishi Heavy Industries, Ltd., Tokyo, Japan

[ * ] Notice: This patent is subject to a terminal disclaimer.

[21] Appl. No.: 08/869,248

[22] Filed: Jun. 4, 1997

[30] Foreign Application Priority Data

Jun. 5, 1996 [JP] Japan ..... 8-142820
Sep. 11, 1996 [JP] Japan ..... 8-240515

[51] Int. Cl.[7] ..... F23B 11/04; F23D 11/44

[52] U.S. Cl. ..... 431/2; 431/4; 431/11; 431/12; 431/208; 431/211

[58] Field of Search ..... 431/4, 11, 12, 431/211, 208, 2

[56] References Cited

U.S. PATENT DOCUMENTS

| | | | |
|---|---|---|---|
| 4,302,177 | 11/1981 | Frankhanel et al. | 431/11 |
| 4,321,132 | 3/1982 | Richards . | |
| 4,460,328 | 7/1984 | Niederholtmeyer | 431/11 |
| 4,573,911 | 3/1986 | Kimmich | 432/179 |
| 5,135,386 | 8/1992 | Kelley et al. | 431/11 |
| 5,149,260 | 9/1992 | Foust | 431/11 |
| 5,263,850 | 11/1993 | Walker | 431/11 |
| 5,271,808 | 12/1993 | Shurtleff | 196/46 |
| 5,382,328 | 1/1995 | Drespa . | |
| 5,816,790 | 10/1998 | Ichinose et al. | 431/4 |

FOREIGN PATENT DOCUMENTS

| | | |
|---|---|---|
| 0044198 | 7/1981 | European Pat. Off. . |
| 0760451 | 7/1996 | European Pat. Off. . |
| 460656 | 6/1967 | Switzerland . |
| 475663 | 6/1936 | United Kingdom . |

*Primary Examiner*—Ira S. Lazarus
*Assistant Examiner*—David Lee
*Attorney, Agent, or Firm*—Wenderoth, Lind & Ponack, L.L.P.

[57] ABSTRACT

A heavy oil emulsion fuel combustion apparatus is arranged, in a combustion apparatus using a heavy oil emulsion fuel, to prevent a decrease in the combustion efficiency due to water content in the fuel and to prevent an increase in the sulfuric acid dew point due to water content in the exhaust gas. A heavy oil emulsion fuel 101 from a fuel tank 100 is led to a fuel heater 110 and is heated. Then the heated heavy oil emulsion fuel 102 is led to a water content evaporator 120. In the water content evaporator 120, the heavy oil emulsion fuel 102 is heated by the use of extraction steam from a steam turbine facility 160 or steam produced through a steam converter 166, and the resulting fuel is led to a steam separator 140. In the steam separator 140, the fuel 111 is separated into steam and light oil combustible gas vapor 121 and a heavy oil portion 122, the latter 122 being used as boiler fuel 131. The steam and light oil combustible gas vapor 121 is used as a heat source for heating performed in the fuel heater 110.

13 Claims, 6 Drawing Sheets

HEAVY OIL EMULSION FUEL COMBUSTION APPARATUS

BACKGROUND OF THE INVENTION

1. Field of the Invention

The present invention relates to a heavy oil emulsion fuel combustion apparatus for public utility or industrial use, such as a heavy oil emulsion fuel combustion boiler, a heavy oil gasifying combined plant arranged to dehydrate water content in the fuel and then gasify the resulting fuel, etc.

2. Description of the Prior Art

The construction of a conventional heavy oil emulsion fuel combustion boiler is illustrated in FIG. 6. In the boiler illustrated in FIG. 6, a heavy oil emulsion fuel 101 is supplied from a fuel tank 100 directly to a burner in a main body 10 of the boiler. To the burner there is supplied an atomizing steam (burner atomization steam) 9 in the heavy oil emulsion fuel 101 to thereby atomize the heavy oil emulsion fuel 101 up to particles whose size enables easy combustion thereof.

Thereafter, the fuel 101 is combusted within the main body 10 of the boiler. On the other hand, another steam 8 is supplied to within the main body of the boiler in order to blow away, for example, ashes that attach onto the heat transfer pipes and the like within the main body 10 of the boiler. The exhaust gas 11 that is produced after combustion made within the main body 10 of the boiler is released from a chimney 50 into the atmosphere through a denitration unit 20, dedusting unit 30 and wet desulfuration unit 40.

In the conventional technique, although as mentioned above the heavy oil emulsion fuel 101 can be supplied at normal temperature to the main body 10 of the boiler, since approximately 20% to 30% of water content is contained in the heavy oil emulsion fuel 101 and the heat for evaporating this water content within the main body 10 of the boiler is necessary, the boiler efficiency decreases.

SUMMARY OF THE INVENTION

An object of the present invention is to provide a heavy oil emulsion fuel combustion apparatus, such as a boiler, gasifying combined plant, etc., using a heavy oil emulsion fuel, which is arranged to prevent a decrease in the combustion efficiency due to the water content in the fuel and to prevent a rise in the sulfuric acid dew point due to the water component that is contained in the exhaust gas.

In order to attain the above object of the heavy oil emulsion fuel combustion apparatus, the present invention heats and dehydrates the heavy oil emulsion fuel and uses the dehydrated fuel as a fuel for a combustion furnace. On the other hand, at least a part of the water that has been obtained after dehydration is supplied to a water utilizing system of the combustion furnace and is used as a substitute for the water that was conventionally supplied from another water source.

In the present invention, extraction steam from a steam turbine or steam procured through a steam converter is used as a heat source for heating the heavy oil emulsion fuel for the purpose of dehydration thereof.

The water utilizing system of the combustion furnace, to which there is supplied the water dehydrated from the heavy oil emulsion fuel, can be selected from at least one of a burner atomizing steam system, a soot blower steam system, desulfuration unit cooling water system, a etc.

Further, preferably, in the heavy oil emulsion fuel combustion apparatus according to the present invention, the steam and light oil combustible gas that have been generated by heating the heavy oil emulsion fuel for the purpose of dehydration thereof are cooled and condensed and taken out by being separated into a water portion and an oil portion.

Further, preferably, in this case, the steam and light oil combustible gas that are generated after having heated the heavy oil emulsion fuel are cooled by heat exchange between them and the heavy oil emulsion fuel prior to being heated to thereby recover the heat by which the heavy oil emulsion fuel has been heated for its dehydration.

Also, preferably, the heavy oil emulsion fuel combustion apparatus according to the present invention is equipped, on a downstream side of a water content evaporator for heating the heavy oil emulsion fuel by steam as mentioned above, thereby performing dehydration and evaporation thereof, with a fuel storage tank for storing therein the dehydrated heavy oil portion. A piping that connects this tank and the water content evaporator is provided with a pressure regulation valve. The apparatus is also provided, at an inlet portion of the tank, with a pressure-reducing nozzle.

The heavy oil emulsion fuel combustion apparatus may also have a flash tank on a piping that connects the fuel storage tank and the water content evaporator instead of the above-mentioned pressure regulation valve and pressure-reducing nozzle.

According to the above-constructed heavy oil emulsion fuel combustion apparatus, since the fuel that is supplied from the water content evaporator to the fuel storage tank is pressure-reduced and has its water content evaporated due to the flash action (the evaporation that occurs due to the isentropic change), it is possible to decrease the amount of evaporation in the water content evaporator by that extent. Accordingly, it is possible to decrease the amount of steam that is supplied from the steam turbine facility to the water content evaporator. It is to be noted that the steam that has been generated due to the flash action is condensed by a condenser and recovered.

As mentioned above, in the heavy oil emulsion fuel combustion apparatus according to the present invention, by dehydrating the water content in the heavy oil emulsion fuel and using only the dehydrated fuel alone as the fuel for use in the combustion furnace, it is possible to prevent a decrease in the combustion efficiency due to supply of a large amount of water into the combustion furnace. Also, since the dehydrated water also is utilized as a substitute for the water to be supplied to the water utilizing system of the combustion furnace, which is otherwise needed to be supplied from a separate water source, the efficiency of the entire combustion apparatus is enhanced.

In addition, since in the heavy oil emulsion fuel combustion apparatus according to the present invention a reheating extraction steam from a steam turbine or the steam obtained through a steam converter is used as a dehydrating heat source for the heavy oil emulsion fuel, it is unnecessary to use a heat exchanger for the purpose of generating steam by means of the sensible heat of the exhaust gas from the combustion furnace. The constituent equipment can thus be simplified, and therefore the controllability of the operation of the apparatus is enhanced. Further, because of not using the sensible heat of the exhaust gas from the combustion furnace, but using the steam that has been used once for the output of the steam turbine, the plant efficiency is enhanced.

In the conventional heavy oil emulsion fuel combustion apparatus the sulfuric acid dew point of the outlet exhaust gas is high as a result of a large amount of water being supplied to the combustion furnace. The result is that dew formation occurs within the equipment or piping located downstream therefrom, and causes the occurrence of trouble such as material corrosion, soot and dust attachments, soot and dust deposition, in worse cases even soot and dust blockage, etc. Since in the heavy oil emulsion fuel combustion apparatus according to the present invention the supply of water to the combustion furnace is decreased through the execution of the above-mentioned means, the occurrence of such trouble can be prevented.

Further, since in the heavy oil emulsion fuel combustion apparatus according to the present invention the heavy oil, having separated therefrom low boiling point components (the water component and the partial light oil component), is supplied to a burner of the combustion furnace, the problem of "vapor-lock" under atomizing temperature conditions (200° C. or so) for heavy oil is resolved. The result is that stable combustion of the heavy oil within the combustion furnace is maintained.

As mentioned above, in the heavy oil emulsion fuel combustion apparatus according to the present invention, the heavy oil emulsion fuel is utilized by being divided into a fuel portion and a water portion. The heavy oil emulsion fuel has been prepared by mixing water (e.g., 30%), on a relevant heavy oil, production spot, into the heavy oil which is a high-viscosity fluid or solid at normal temperature, and thereby converting it to a fuel emulsion for the purpose of improving the transportability and handleability thereof, thereby making it possible to handle it as a fluid at normal temperature. However, this fuel emulsion is not needed to be used as is. If as in the case of the combustion apparatus of the present invention this fuel emulsion is made usable by being dehydrated again, it will be advantageous from the viewpoint of the efficiency of the combustion apparatus.

DETAILED DESCRIPTION OF THE PREFERRED EMBODIMENTS

Figure 1:
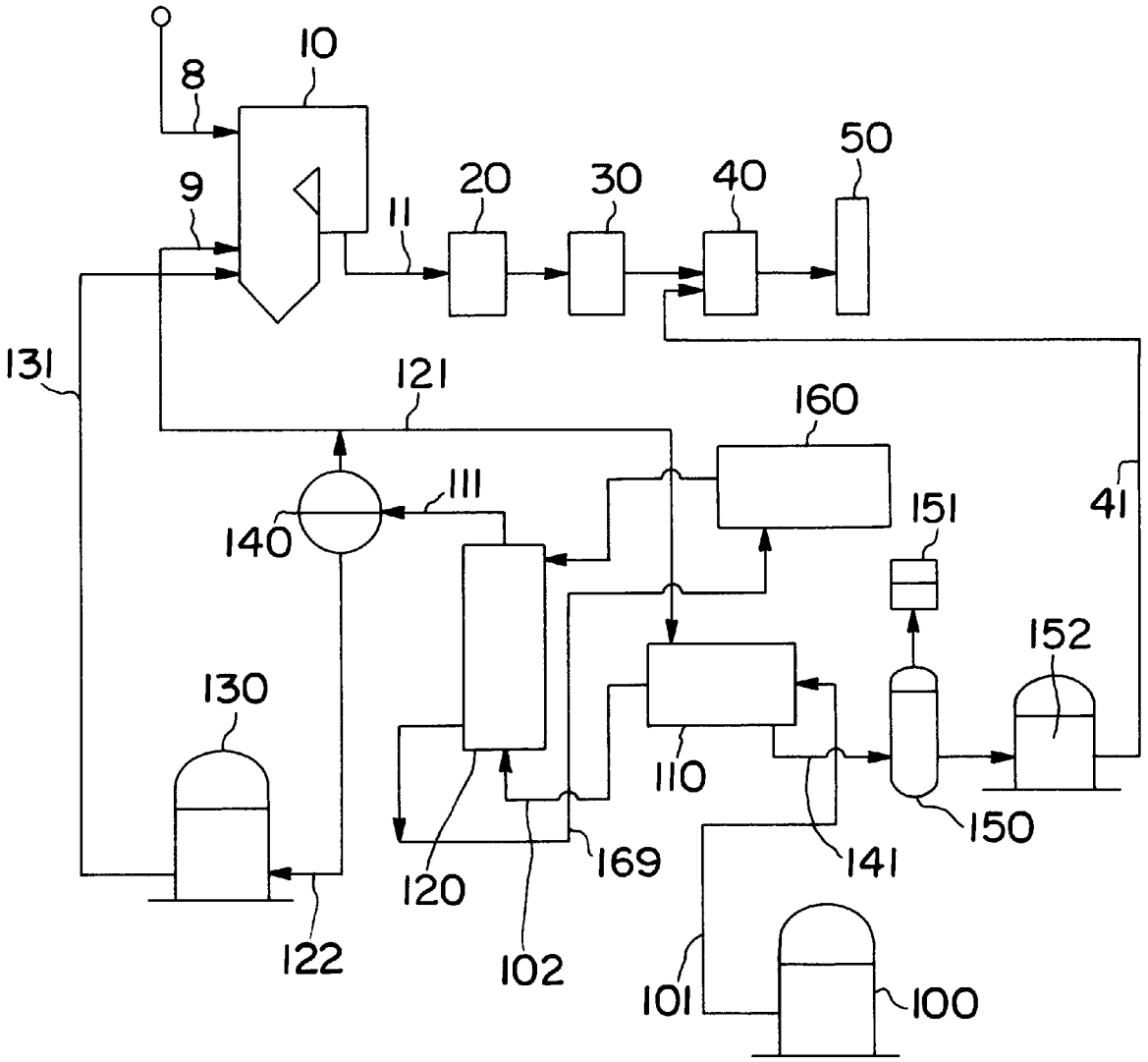
FIG. 1 is a systematic diagram illustrating a heavy oil emulsion fuel combustion apparatus according to a first embodiment of the present invention.
Figure 2:
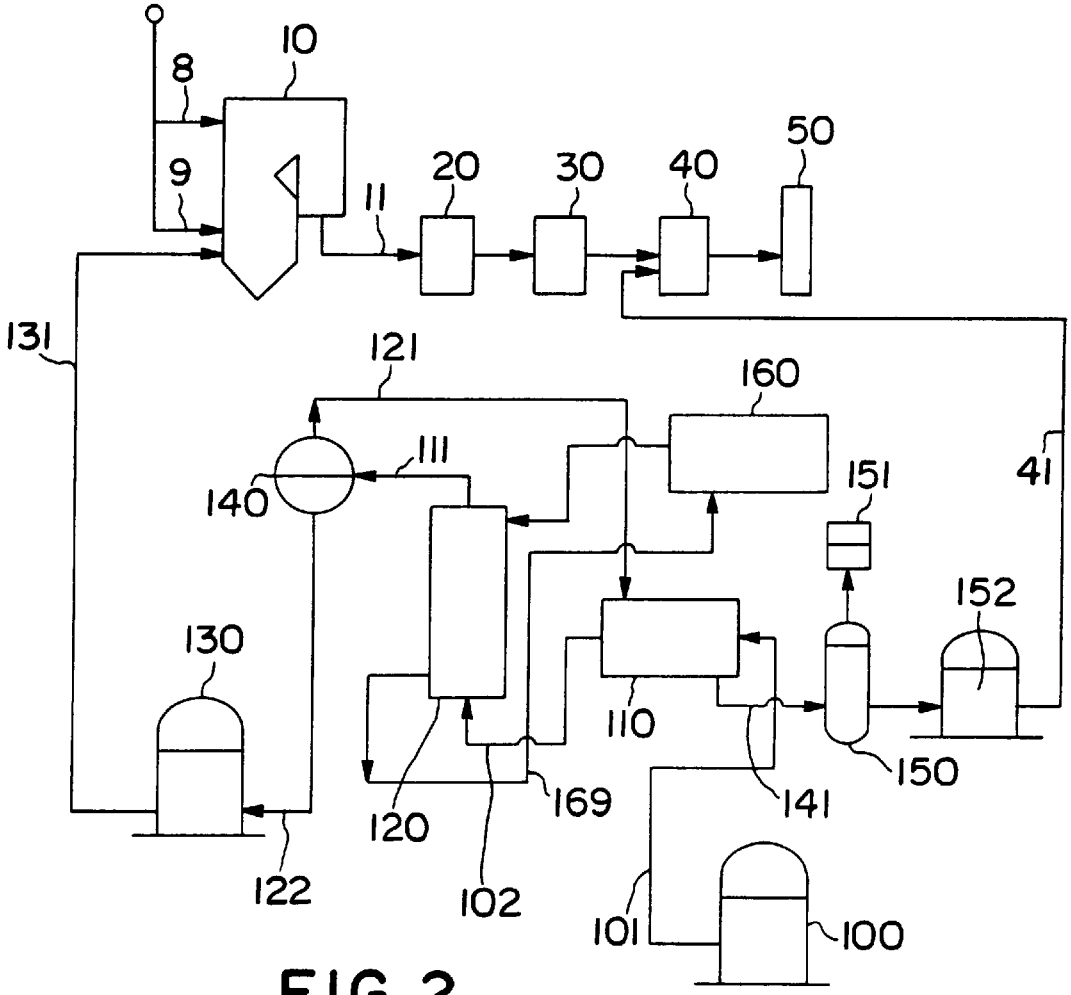
FIG. 2 is a systematic diagram illustrating a heavy oil emulsion fuel combustion apparatus according to a second embodiment of the present invention.
Figure 6:
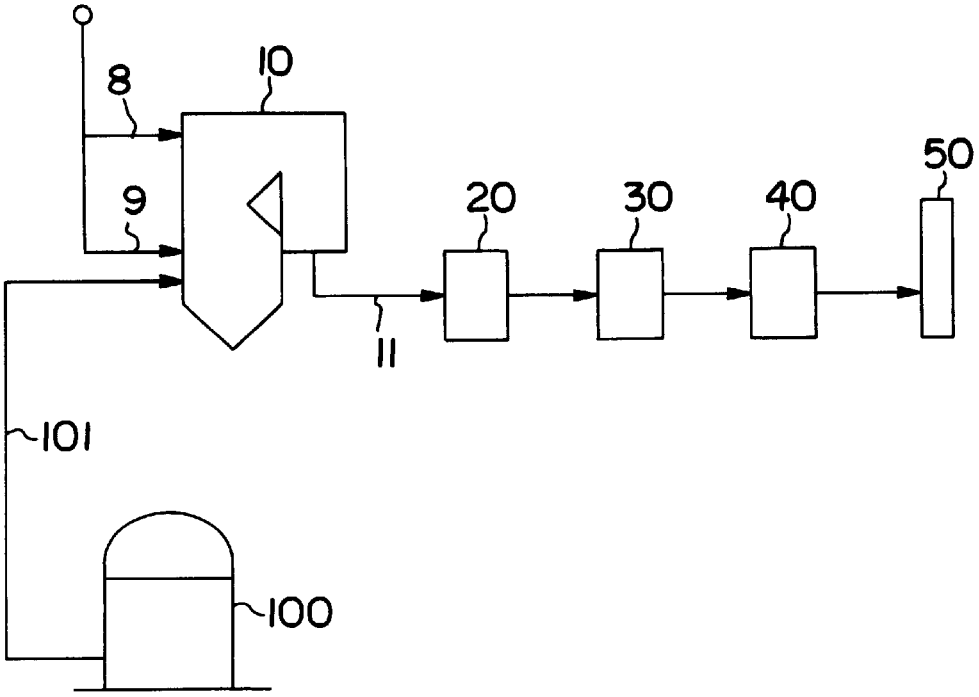
FIG. 6 PRIOR ART
FIG. 6 is a systematic diagram illustrating a conventional heavy oil emulsion fuel combustion boiler.

A heavy oil emulsion fuel combustion apparatus according to the present invention will now be explained in detail with reference to FIGS. 1 and 2 illustrating embodiments wherein the present invention is applied to a boiler. It is to be noted that in the following embodiments the same constituent components as those of the conventional apparatus illustrated in FIG. 6 are denoted by the same reference symbols for brevity of the explanation.

First Embodiment

First, an explanation will be given of a heavy oil emulsion fuel combustion boiler according to a first embodiment illustrated in FIG. 1. This boiler is a heavy oil emulsion fuel combustion boiler which, as in the case of the boiler illustrated in FIG. 6, is composed of a main body 10 of the boiler and a denitration unit 20, dedusting unit 30, wet desulfuration unit 40, chimney 50 and the like of an exhaust gas treating system, and which has disposed therein a fuel supply system comprising a dehydrating system for dehydrating a water portion in a heavy oil emulsion fuel. Numeral 160 denotes a steam turbine facility.

The dehydrating system of the combustion boiler illustrated in FIG. 1 is composed of a heavy oil emulsion fuel tank 100, heavy oil emulsion fuel heater 110, within-fuel water content evaporator 120, dehydrated-fuel storage tank 130, steam separator 140, oil/water separator 150, etc.

The fuel that has been transported from a heavy oil emulsion fuel production spot is stored in the fuel tank 100. A heavy oil emulsion fuel 101 that is supplied from this tank 100 through a pump (not illustrated) absorbs, within the heavy oil emulsion fuel heater 110 as later described, the latent heat and sensible heat of vapor 121 composed of steam and light oil combustible gas, whereby the temperature thereof rises.

A heavy oil emulsion fuel 102 from the heavy oil emulsion fuel heater 110 is supplied to the water content evaporator 120. As a heating source for heating the water content evaporator 120 there is used the sensible heat of a part of reheating extraction steam for a high-pressure/middle-pressure steam turbine 161 of a steam turbine facility 160 illustrated in FIG. 5 or the sensible heat of steam from a steam converter 166.

Figure 5:
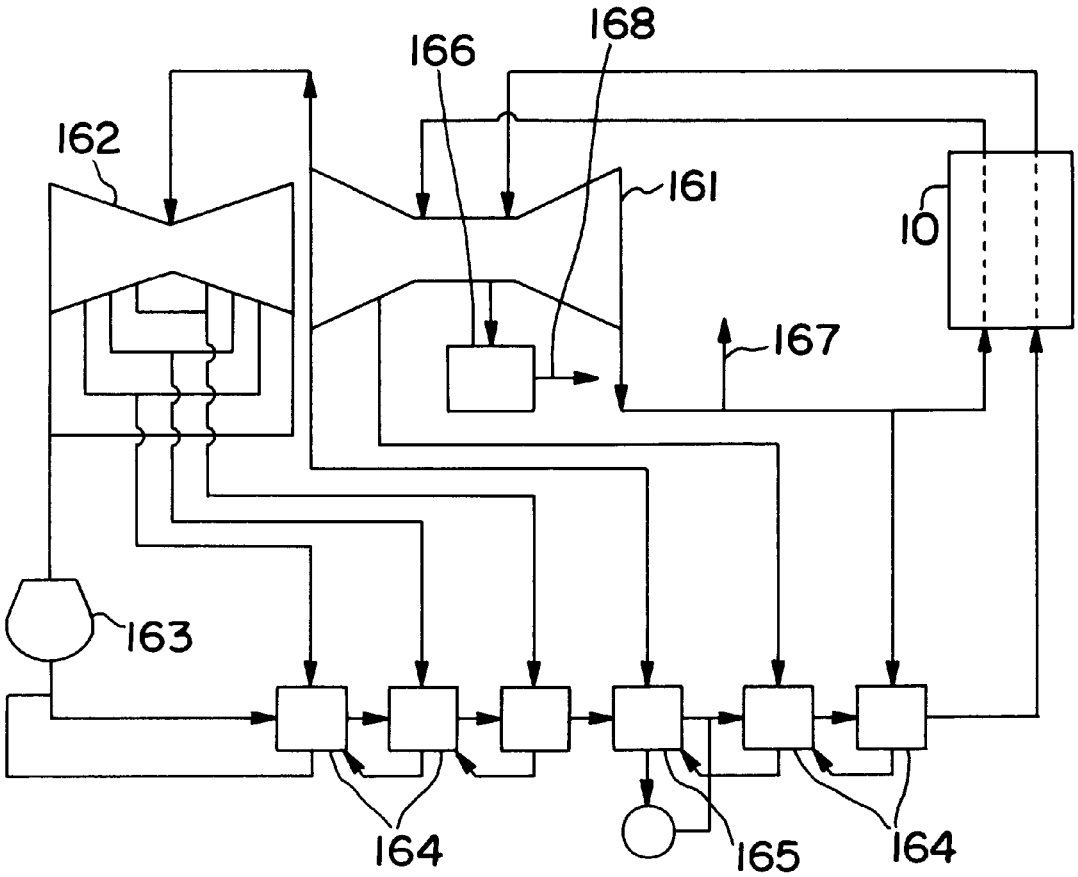
FIG. 5 is a view illustrating the system of a steam turbine that is illustrated in FIGS. 1 and 2.

A concrete construction of the steam turbine facility 160 is illustrated in FIG. 5. The steam turbine facility 160 is composed of the high-pressure/middle-pressure steam turbine 161, low-pressure steam turbine 162, condenser 163, feed water heater 164, deaerator 165, steam converter 166, etc.

As the steam for evaporating the water content in the heavy oil emulsion fuel by the water content evaporator 120 in the dehydrating system there is used the reheating extraction steam 167 from the high-pressure/middle-pressure steam turbine 161 or boiler soot blower steam 168 from the steam converter 166. Condensed water 169 from the water content evaporator 120 is returned again back to the deaerator 165.

Part of reheating extraction steam 167 from the high-pressure/middle-pressure steam turbine 161 is superheated steam of, for example, 260° C. and, after having exited from the water content evaporator 120, is returned back to the deaerator 165 of the steam turbine facility.

The fuel 111 whose temperature is elevated, after it has been supplied to the water content evaporator 120 and heated by steam as mentioned above, is separated into a heavy oil portion 122 and the vapor 121 composed of steam and light oil combustible gas. After having been stored once in the fuel storage tank 130, the heavy oil portion 122 is supplied as a boiler fuel 131 to a burner port of the main body 10 of the boiler.

Since this heavy oil portion 122 that is supplied to the burner port of the main body of the boiler is a heavy oil portion that has separated therefrom the low boiling point components (water component and light oil component), the state of "vapor-lock" under atomizing temperature conditions (200° C. or so) for heavy oil is resolved with the result that stable combustion of the heavy oil in the boiler is maintained.

It is to be noted that since the heavy oil portion 122 ceases to have fluidity at normal temperature when the vapor 121 that is composed of steam and light oil combustible gas has been evaporated, it is needed to heat the fuel storage tank 130 and the piping that extends from it to the burner port to thereby maintain the fluidity of the heavy oil portion.

The vapor 121 that has been evaporated in the water content evaporator 120 is partly used as an atomizing steam 9 for the boiler burner. The rest of this vapor 121 has its own latent and sensible heat recovered in the fuel heater 110 and then, after being condensed, becomes a liquid 141 that is composed of water and light oil portions in a mixed state.

While the atomizing steam 9 is indispensable for the main body 10 of the boiler and, unless the water content in the fuel is utilized therefor as mentioned above, is needed to be supplied from another source, since the water content in the fuel can be used as a substitute therefor, it is possible to decrease the amount of water to be supplied to the boiler and thereby improve the efficiency of the boiler and enhance the reliability of the downstream equipments.

In order to effectively utilize this water portion and oil portion within the same system of the apparatus, these two portions are separated by the oil/water separator 150 into an oil portion 151 and a water portion 152. The oil portion 151 is used as a fuel for, for example, an ignition torch of the boiler, etc., and the water portion 152 is used as a cooling water 41 for cooling the wet desulfuration unit 40.

Also, as in the case of the atomizing steam, the cooling water 41 for use in the desulfuration unit 40 is indispensable for the boiler. By utilizing the separated water portion as mentioned above, it is possible to decrease the amount of water that is to be used for the plant.

Also, in this embodiment, since the reheating extraction steam 167 from the steam turbine is used as the heat source for dehydrating the heavy oil emulsion fuel, it becomes unnecessary to use a heat exchanger that is intended to generate steam with the use of the sensible heat of the exhaust gas in the boiler and it also becomes possible to simplify the constituent equipment, with the result that the controllability of the system operation of the apparatus is improved. Furthermore, since the sensible heat of the exhaust gas in the boiler is not used, and rather the steam that has been used once for the output of the steam turbine is used, the efficiency of the plant is enhanced.

Also, the liquid 141, or the liquid 141 whose part is vapor, having gotten out of the fuel heater 110 and having a light oil component mixed therein, preferably has its sensible heat recovered in a feed water heating line that extends from the condenser 163 to the deaerator 165 of the steam turbine facility 160.

Second Embodiment

Next, an explanation will be given of a heavy oil emulsion fuel combustion boiler according to a second embodiment illustrated in FIG. 2. This boiler is a heavy oil emulsion fuel combustion boiler which, as in the case of the boiler illustrated in FIG. 1, is composed of a main body 10 of the boiler and a denitration unit 20, dedusting unit 30, wet desulfuration unit 40, chimney 50 and the like of an exhaust gas treating system. It has disposed therein a fuel supply system comprising a dehydrating system for dehydrating a water portion in a heavy oil emulsion fuel. Numeral 160 denotes a steam turbine facility.

The dehydrating system of the combustion boiler illustrated in FIG. 2 is constructed using the same equipment as in FIG. 1 and the dehydrating system flow is also the same as in FIG. 1. However, in the second embodiment, a part of the evaporated vapor 121 is not used as the atomizing steam for the boiler burner. The whole of the vapor 121 is led to the fuel heater 110, and its own latent and sensible heat is recovered therein. Then, after being condensed, the vapor 121 becomes a liquid 141 that has a water component and a light oil component in a mixed state.

In order to effectively utilize this water component and oil component respectively within the same system of the apparatus, these two components are separated by the oil/water separator 150 into an oil portion 151 and a water portion 152. The oil portion 151 is used as a fuel for, for example, the ignition torch of the boiler etc., and the water portion 152 is totally used as a cooling water 41 for cooling the desulfuration unit 40.

Although in this embodiment the steam dehydrated from the heavy oil emulsion fuel is not used as the atomizing steam, and therefore the efficiency is slightly decreased and the amount of water utilized is slightly increased compared to the embodiment of FIG. 1, since the total amount of the dehydrated water portion is led to the heavy oil emulsion fuel heater 110, the difference between the temperature of the dehydrated steam and the temperature of the heavy oil emulsion fuel increases, with the result that it becomes possible to make the fuel heater 110 compact.

Further, since the atomizing steam is supplied from a system (e.g., the steam converter 166 of the steam turbine system as in the prior art) that is separate from the fuel supply system and dehydrating facility, it is possible to enhance the controllability of the operation of the apparatus, including the operation of the dehydrating facility with respect to the load variation and trip of the boiler.

Third Embodiment

Next, a heavy oil emulsion fuel combustion boiler according to a third embodiment illustrated in FIG. 3 will be explained. In the boiler illustrated in FIG. 3, a pressure-regulating valve 145 is provided on a piping that connects the steam separator 140 and the fuel storage tank 130. Also, a pressure-reducing nozzle 146 is provided at the inlet of the fuel storage tank 130.

Further, a level controller 173 and a level control valve 172 are installed with respect to the steam separator 140, whereby it is arranged that the liquid surface level of the steam separator 140 is controlled to be at the highest level. Numeral 171 denotes a condenser. The remaining construction is substantially the same as in the case of the boiler illustrated in FIG. 1 and its explanation is omitted.

Figure 3:
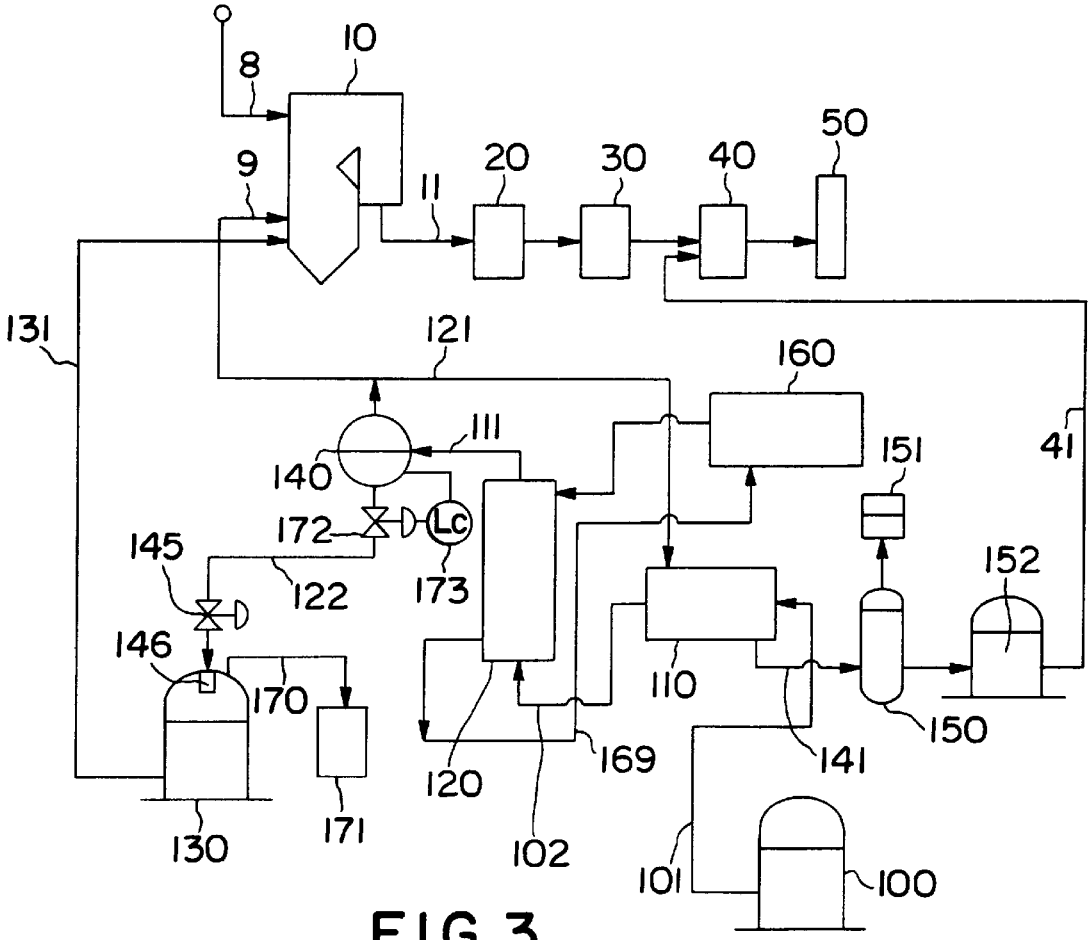
FIG. 3 is a systematic diagram illustrating a heavy oil emulsion fuel combustion apparatus according to a third embodiment of the present invention.

Since the heavy oil emulsion fuel combustion boiler illustrated in FIG. 3 has the above-mentioned construction, the heavy oil portion 122 that has been separated by the steam separator 140 has its pressure regulated by the pressure-regulating valve 145 and is then pressure-reduced down to the atmospheric pressure to 2 atm by the pressure-reducing nozzle 146 that has been disposed at the inlet of the fuel storage tank 130. Then, the resulting heavy oil 122 is stored once in the fuel storage tank 130 and is then supplied as the boiler fuel to the burner port of the boiler 10.

Here, the pressure-regulating valve 145 has a function of finely adjusting the pressure of the system and, by reducing the pressure of the heavy oil portion 122 with the pressure-reducing nozzle 146, the heavy oil portion 122 is evaporated due to flash action (evaporation caused due to isentropic change). Accordingly, in correspondence therewith, it is possible to decrease the amount of evaporation in the water content evaporator 120, namely to decrease the amount of steam supplied from the steam turbine facility 160. According to a trial computation, the amount of steam supplied can be decreased by approximately 10%.

Further, since there is a decreased amount of the steam produced by evaporation made in the water content evaporator 120, the temperature of the liquid 141 which has a water component and a light oil component in a mixed state and which is at the outlet of the heavy oil emulsion fuel heater 110 decreases. In consequence, it becomes possible to reduce the size of a heat-recovering or cooling heat exchanger (not illustrated) that is installed between the outlet of the fuel heater 110 and the oil/water separator 150. It is to be noted that the steam 170 that has been produced due to the flash is condensed in the condenser 171.

Fourth Embodiment

Next, a heavy oil emulsion fuel combustion boiler according to a fourth embodiment illustrated in FIG. 4 will be explained. In the boiler illustrated in FIG. 4, numeral 147 denotes a flash tank on which the pressure-reducing nozzle 146 is installed.

Figure 4:
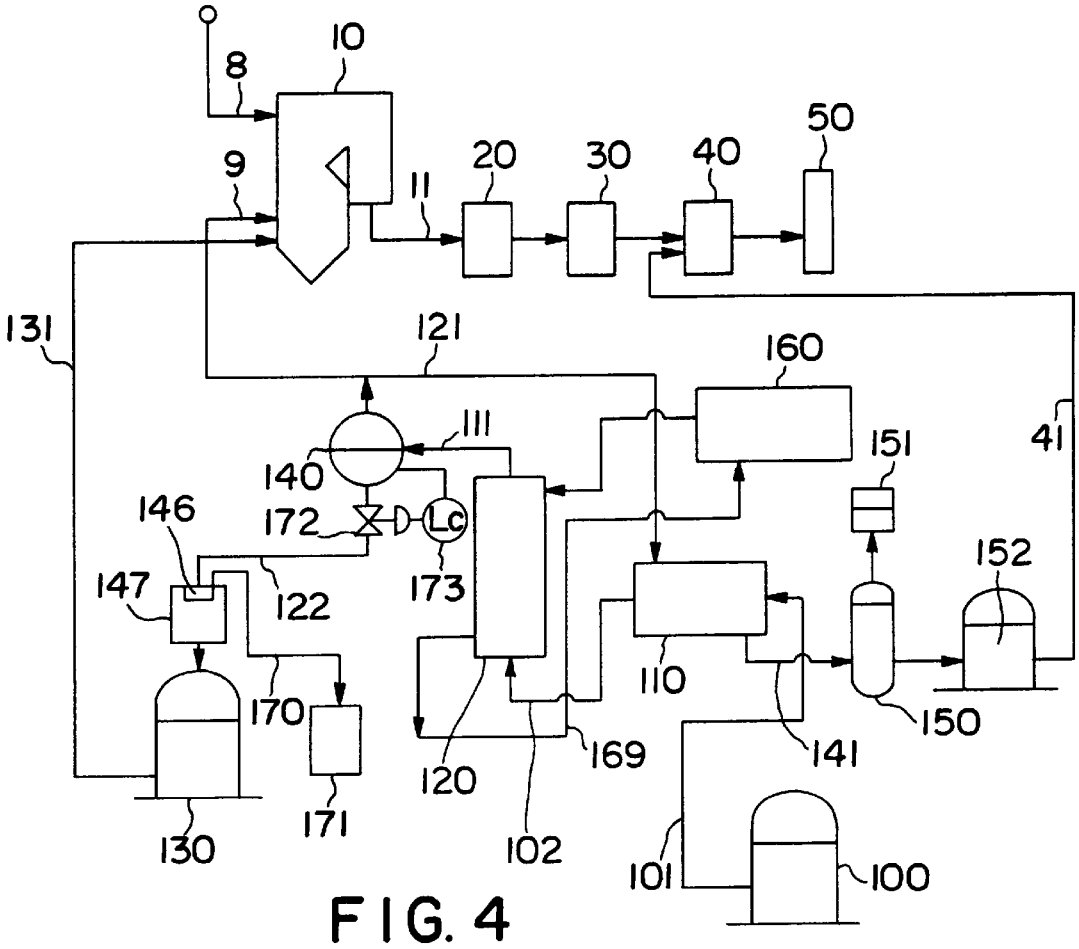
FIG. 4 is a systematic diagram illustrating a heavy oil emulsion fuel combustion apparatus according to a fourth embodiment of the present invention.

The boiler of FIG. 4 is substantially the same as the boiler illustrated in FIG. 3, except that instead of the pressure-regulating valve 145 and the nozzle 146 installed on the fuel storage tank 130, the flash tank 147 has been disposed in this way between the steam separator 140 and the fuel storage tank 130.

While in the heavy oil emulsion fuel combustion boiler of FIG. 3 pressure reduction (flash) is performed in the fuel storage tank 130, in the boiler illustrated in FIG. 4 the flash tank 147 is installed and, by the pressure level adjustment performed in the flash tank 147, control is performed of the amount of flash evaporation.

The following is to be noted. In the boiler illustrated in FIG. 4, because of no pressure-regulating valve 145 being provided, the pressure control is performed by controlling the bore size or flow rate of the pressure-reducing nozzle 146 installed on the flash tank 147. However, if otherwise, it is possible to control the pressure of the system and the pressure of the fuel storage tank 130 by installing the pressure-regulating valve or pressure-regulating orifice.

As has been mentioned above, in the heavy oil emulsion fuel combustion apparatus according to the present invention, it is arranged to supply the heavy oil emulsion fuel to the combustion furnace after heating and dehydrating the same and also to supply at least a part of the dehydrated water to the water utilizing system of the combustion furnace as mentioned above. According to this arrangement, it is possible to largely decrease the water that is supplied to the heavy oil emulsion fuel combustion apparatus to thereby enhance the combustion efficiency and settle the problem of trouble such as soot and dust attachment, soot and dust deposition, soot and dust blockage, etc. of the downstream equipment due to a rise in the sulfuric acid dew point, thereby achieving an enhancement in the apparatus reliability.

In addition, in the heavy oil emulsion fuel combustion apparatus according to the present invention, since the reheating extraction steam from the steam turbine or the steam procured through the steam converter is used as the dehydrating heat source for dehydrating the heavy oil emulsion fuel, the use of a heat exchanger for producing steam by the use of the sensible heat of the exhaust gas from the combustion furnace becomes unnecessary, with the result that a simplification of the constituent equipment becomes possible. In consequence, the controllability of the system operation of the apparatus is enhanced. Further, since the sensible heat of the exhaust gas from the combustion furnace is not used, and rather the steam that has been used once for the output of the steam turbine is used, the efficiency of the plant is enhanced.

What is claimed is:

1. A heavy oil emulsion fuel combustion apparatus adapted to heat and dehydrate a heavy oil emulsion fuel, the resulting fuel being supplied to a combustion furnace and at least a part of the dehydrated water being supplied to a water utilizing system of the combustion furnace, wherein the heating of the heavy oil emulsion fuel is performed with the use of extraction steam from a steam turbine or steam produced through a steam converter.

2. A heavy oil emulsion fuel combustion apparatus as set forth in claim 1, wherein the water utilizing system is at least one of a burner atomizing steam system, soot blower steam system and desulfuration unit cooling water system.

3. A heavy oil emulsion fuel combustion apparatus as set forth in claim 1, wherein steam and light oil combustible gas which are generated when having heated the heavy oil emulsion fuel are cooled and condensed, whereby the both components are taken out by being separated into a water portion and an oil portion.

4. A heavy oil emulsion fuel combustion apparatus as set forth in claim 3, wherein a part, or the whole, of the steam and light oil combustible gas which are generated when having heated the heavy oil emulsion fuel is cooled by heat exchange with the heavy oil emulsion fuel before heated.

5. A heavy oil emulsion fuel combustion apparatus as set forth in claim 1, comprising a fuel storage tank for storing therein a dehydrated heavy oil portion at a position that is located downstream from a water content evaporator for heating, dehydrating and evaporating the heavy oil emulsion fuel by the use of the steam, whereby a pressure-regulating valve is disposed on a piping that connects the fuel storage tank and the water content evaporator and a pressure-reducing nozzle is disposed at an inlet portion of the fuel storage tank.

6. A heavy oil emulsion fuel combustion apparatus as set forth in claim 1, comprising a fuel storage tank for storing therein a dehydrated heavy oil portion at a position that is located downstream from a water content evaporator for heating, dehydrating and evaporating the heavy oil emulsion fuel by the use of the steam, whereby a flash tank is disposed on a piping that connects the fuel storage tank and the water content evaporator.

7. A heavy oil emulsion fuel combustion apparatus, comprising:

a heavy oil emulsion fuel heating and dehydrating system adapted to heat and dehydrate a heavy oil emulsion fuel, producing a resulting heated and dehydrated emulsion fuel and dehydrated water;

a combustion furnace receiving the resulting heated and dehydrated emulsion fuel from said heavy oil emulsion fuel heating and dehydrating system;

a water utilizing system of said combustion furnace receiving the dehydrated water from said heavy oil emulsion fuel heating and dehydrating system; and a steam source connected with said heavy oil emulsion fuel heating and dehydrating system for supplying steam thereto for heating the heavy oil emulsion fuel, said steam source comprising a steam turbine providing extraction steam or a steam converter.

8. The heavy oil emulsion fuel combustion apparatus of claim 7, wherein said water utilizing system is selected from the group consisting of a burner atomizing steam system, a soot blower steam system and a desulfurization unit cooling water system.

9. The heavy oil emulsion fuel combustion apparatus of claim 7, wherein said heavy oil emulsion fuel heating and dehydrating system has a steam and light oil combustible gas cooling and condensing system connected thereto for cooling and condensing steam and light oil combustible gas produced by heating the heavy oil emulsion fuel, said steam and light oil combustible gas cooling and condensing system comprising a water and oil separator separating a water portion and an oil portion of the cooled and condensed steam and light oil combustible gas.

10. The heavy oil emulsion fuel combustion apparatus of claim 9, wherein said heavy oil emulsion fuel heating and dehydrating system comprises a heat exchanger exchanging heat between at least a part of the steam and light oil combustible gas and the heavy oil emulsion fuel before heating of the heavy oil emulsion fuel.

11. The heavy oil emulsion fuel combustion apparatus of claim 7, wherein:

a fuel storage tank is connected to said heavy oil emulsion fuel heating and dehydrating system for storing dehydrated heavy oil therein, said fuel storage tank having an inlet portion;

said heavy oil emulsion fuel heating and dehydrating system includes a water content evaporator for heating, dehydrating and evaporating the heavy oil emulsion fuel with steam;

said fuel storage tank is located downstream of said water content evaporator and is connected thereto by piping;

a pressure regulating valve is disposed on said piping; and a pressure reducing nozzle is disposed at said inlet portion of said fuel storage tank.

12. The heavy oil emulsion fuel combustion apparatus of claim 7, wherein:

a fuel storage tank is connected to said heavy oil emulsion fuel heating and dehydrating system for storing dehydrated heavy oil therein;

said heavy oil emulsion fuel heating and dehydrating system includes a water content evaporator for heating, dehydrating and evaporating the heavy oil emulsion fuel with steam;

said fuel storage tank is located downstream of said water content evaporator and is connected thereto by piping; and a flash tank is disposed on said piping between said fuel storage tank and said water content evaporator.

13. A heavy oil emulsion fuel combustion apparatus, comprising:

a heavy oil emulsion fuel heating and dehydrating system adapted to heat and dehydrate a heavy oil emulsion fuel, producing a resulting heated and dehydrated emulsion fuel and dehydrated water, said heavy oil emulsion fuel heating and dehydrating system comprising an evaporator having an input connected to a heavy oil emulsion fuel source, a heated heavy oil emulsion fuel outlet and a steam inlet;

a combustion furnace receiving the resulting heated and dehydrated emulsion fuel from said heavy oil emulsion fuel heating and dehydrating system;

a water utilizing system of said combustion furnace receiving the dehydrated water from said heavy oil emulsion fuel heating and dehydrating system; and a steam source connected with steam inlet of said evaporator of said heavy oil emulsion fuel heating and dehydrating system for supplying steam thereto for heating the heavy oil emulsion fuel, said steam source comprising an extraction steam from a steam turbine or steam produced by a steam converter.

* * * * *